US007841217B2

(12) United States Patent
Lueckenbach et al.

(10) Patent No.: US 7,841,217 B2
(45) Date of Patent: Nov. 30, 2010

(54) CLOTHES WASHER TEMPERATURE CONTROL SYSTEMS AND METHODS

(75) Inventors: William H. Lueckenbach, Crestwood, KY (US); Fred Dennis Kedjierski, Statesville, NC (US); Ronald Miles Johnson, Jeffersontown, KY (US); Erick Paul Graven, Louisville, KY (US)

(73) Assignee: General Electric Company, Schenectady, NY (US)

( * ) Notice: Subject to any disclaimer, the term of this patent is extended or adjusted under 35 U.S.C. 154(b) by 176 days.

(21) Appl. No.: 10/249,229

(22) Filed: Mar. 24, 2003

(65) Prior Publication Data

US 2004/0187224 A1 Sep. 30, 2004

(51) Int. Cl.
*D06F 39/00* (2006.01)

(52) U.S. Cl. ..... 68/12.23; 68/12.03; 68/12.21; 8/158

(58) Field of Classification Search ..... 68/12.23
See application file for complete search history.

(56) References Cited

U.S. PATENT DOCUMENTS

| | | | | | |
|---|---|---|---|---|---|
| 2,414,354 | A | * | 1/1947 | Blomberg | 222/318 |
| 4,147,297 | A | * | 4/1979 | Worst | 236/12.12 |
| 4,223,379 | A | | 9/1980 | Simcoe | |
| 4,224,530 | A | | 9/1980 | Simcoe et al. | |
| 4,406,401 | A | * | 9/1983 | Nettro | 236/12.12 |
| 4,410,329 | A | | 10/1983 | Blevins et al. | |
| 4,528,709 | A | * | 7/1985 | Getz et al. | 8/158 |
| 4,643,350 | A | * | 2/1987 | DeSchaaf et al. | 236/12.12 |
| 5,231,722 | A | * | 8/1993 | Shacklock et al. | 8/159 |
| 5,272,892 | A | * | 12/1993 | Janutka et al. | 68/12.02 |
| 5,307,650 | A | | 5/1994 | Mertz | |
| 5,585,704 | A | | 12/1996 | Elzind | |
| 5,647,231 | A | | 7/1997 | Payne et al. | |
| 5,739,534 | A | | 4/1998 | Estenson et al. | |
| 5,873,518 | A | * | 2/1999 | Richmond et al. | 236/12.12 |
| 6,038,519 | A | | 3/2000 | Gauthier et al. | |
| 6,110,292 | A | | 8/2000 | Jewett et al. | |
| 6,151,742 | A | | 11/2000 | Dausch et al. | |
| 6,195,588 | B1 | | 2/2001 | Gauthier et al. | |
| 6,327,730 | B1 | * | 12/2001 | Corbett | 8/158 |
| 6,634,048 | B1 | * | 10/2003 | Hornung et al. | 8/158 |
| 6,845,536 | B1 | * | 1/2005 | Vaidhyanathan et al. | 8/158 |

OTHER PUBLICATIONS

Canadian Intellectual Property Office, Requisition by the Examiner for Application No. 2,430,452, Jan. 13, 2010, 3 pages.

* cited by examiner

*Primary Examiner*—Michael Barr
*Assistant Examiner*—Jason P Riggleman
(74) *Attorney, Agent, or Firm*—George L. Rideout, Esq.; Armstrong Teasdale LLP

(57) ABSTRACT

A washing machine wherein a cold water valve is opened during a hot fill operation is described. In one embodiment, the washing machine comprises a cabinet, a tub and basket mounted within the cabinet, and an agitation element mounted within the basket. The machine also includes a cold water valve for controlling flow of cold water to the tub, and a hot water valve for controlling flow of hot water to the tub. A control coupled to the cold water valve controls opening and closing of the cold water valve during the hot fill operation.

4 Claims, 6 Drawing Sheets

CLOTHES WASHER TEMPERATURE CONTROL SYSTEMS AND METHODS

BACKGROUND OF INVENTION

This invention relates generally to washing machines, and more particularly, to methods and apparatus for controlling wash temperatures.

Washing machines typically include a cabinet that houses an outer tub for containing wash and rinse water, a perforated clothes basket within the tub, and an agitator within the basket. A drive and motor assembly is mounted underneath the stationary outer tub to rotate the basket and the agitator relative to one another, and a pump assembly pumps water from the tub to a drain to execute a wash cycle. See, for example, U.S. Pat. No. 6,029,298.

At least some known washing machines provide that an operator can select from three wash temperatures. Such machines have valve systems including hot and cold water valves. For a hot wash operation, for example, the hot water valve is turned on, i.e., opened, and for a cold wash operation, the cold valve is opened. For a warm wash, both the hot valve and cold valve are opened. The flow rates of water through the valves is selected so that the desired warm temperature is achieved using hot and cold water.

Reducing hot water usage in a washing machine facilitates reducing energy consumption by the machine during wash operations. Avoiding the use of only hot water during a hot wash, for example, would facilitate reducing the energy consumption of the washing machine. Specifically, by adding cold water for a hot wash operation, the water level required for the hot wash can be achieved and less hot water is used.

To add cold water for a hot wash operation, an additional cold water valve could be added to the valve system. The additional cold water valve for the hot wash would have a different flow rate than the cold water valve for the cold wash since less cold water would be added during a hot wash as compared to the amount of cold water added for a cold wash.

Adding an additional cold water valve for hot wash operations, however, increases the cost and complexity of the washing machine. In addition, the fill rate for a washing machine is dependent on water pressure, and water pressure can vary significantly from installation to installation. For example, if a single timed control scheme is used for adding cold water during a hot wash operation, for houses with high water pressure, too much cold water could be added during a hot wash and for houses with low water pressure, too little cold water would be added.

A temperature sensing device and a microprocessor also could be added to the system to facilitate adding cold water during a hot wash. Specifically, the temperature sensing device would be positioned to generate a signal representative of the water temperature in the tub, and the microprocessor would be coupled to the temperature sensing device and programmed to control opening and closing of the hot and cold water valves. Under control of the microprocessor, the amount of cold water flowing to the tub would be adjusted based on the temperature of the water in the tub. Adding a temperature sensing device and a microprocessor, however, increases the cost and complexity of the washing machine.

SUMMARY OF INVENTION

A washing machine wherein a cold water valve is opened during a hot fill operation is provided. In one embodiment, the washing machine comprises a cabinet, a tub and basket mounted within the cabinet, and an agitation element mounted within the basket. The machine also includes a cold water valve for controlling flow of cold water to the tub, and a hot water valve for controlling flow of hot water to the tub. A control coupled to the cold water valve controls opening and closing of the cold water valve during the hot fill operation.

In another aspect, a method for controlling a washing machine during a hot fill operation is provided. The washing machine includes a hot water valve and a cold water valve, and the method comprising the steps of opening the hot water valve, and for at least a period of time, opening the cold water valve during a hot fill operation.

DETAILED DESCRIPTION

Figure 1:
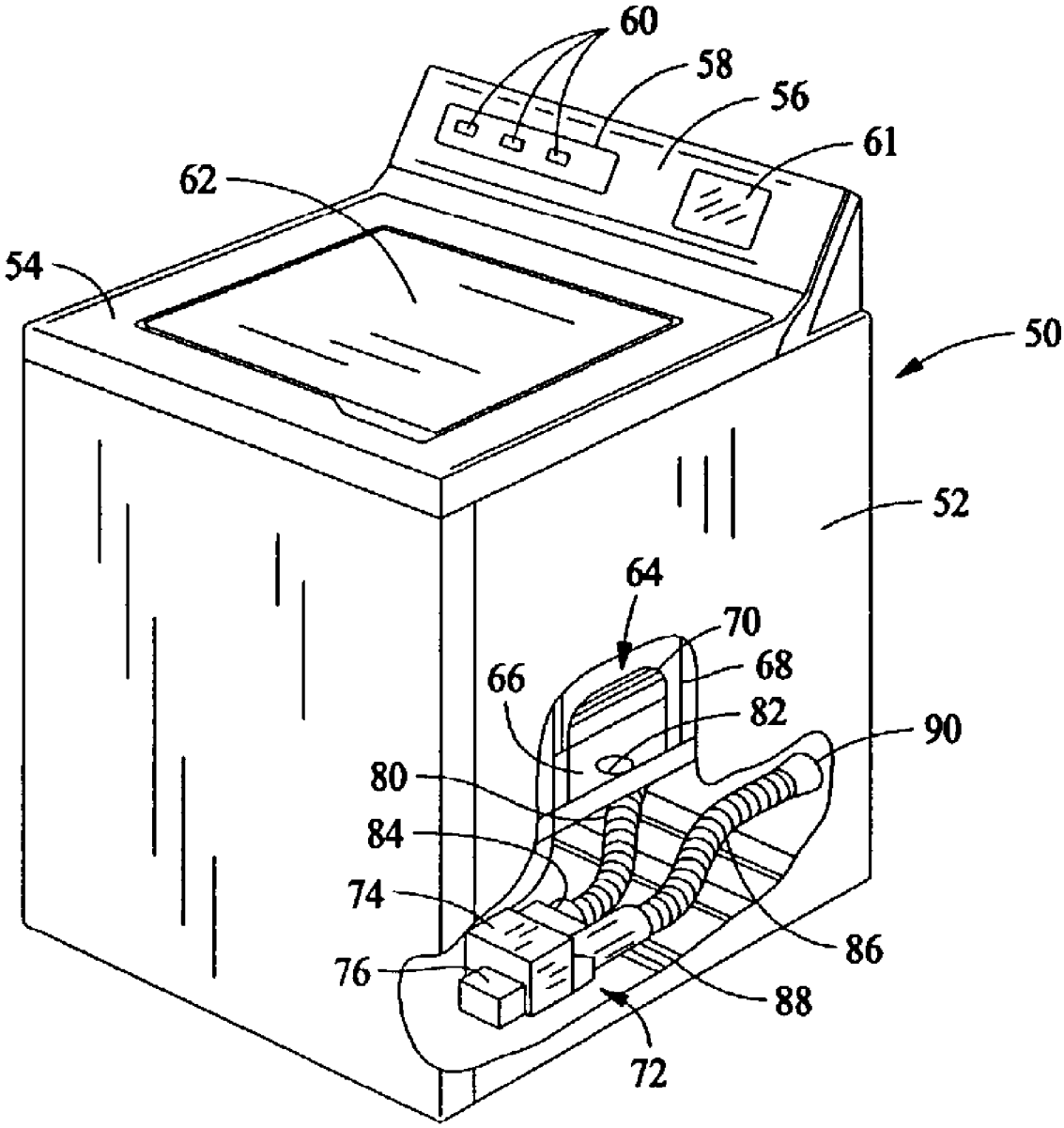
FIG. 1 is a perspective cutaway view of an exemplary washing machine.

FIG. 1 is a perspective view partially broken away of an exemplary washing machine 50 including a cabinet 52 and a cover 54. A backsplash 56 extends from cover 54, and a control panel 58 including a plurality of input selectors 60 is coupled to backsplash 56. Control panel 58 and input selectors 60 collectively form a user interface input for operator selection of machine cycles and features, and in one embodiment a display 61 indicates selected features, a countdown timer, and other items of interest to machine users. A lid 62 is mounted to cover 54 and is rotatable about a hinge (not shown) between an open position (not shown) facilitating access to a wash tub 64 located within cabinet 52, and a closed position (shown in FIG. 1) forming a sealed enclosure over wash tub 64. As illustrated in FIG. 1, machine 50 is a vertical axis washing machine.

Tub 64 includes a bottom wall 66 and a sidewall 68, and a basket 70 is rotatably mounted within wash tub 64. A pump assembly 72 is located beneath tub 64 and basket 70 for gravity assisted flow when draining tub 64. Pump assembly 72 includes a pump 74 and a motor 76. A pump inlet hose 80 extends from a wash tub outlet 82 in tub bottom wall 66 to a pump inlet 84, and a pump outlet hose 86 extends from a pump outlet 88 to an appliance washing machine water outlet 90 and ultimately to a building plumbing system discharge line (not shown) in flow communication with outlet 90.

Figure 2:
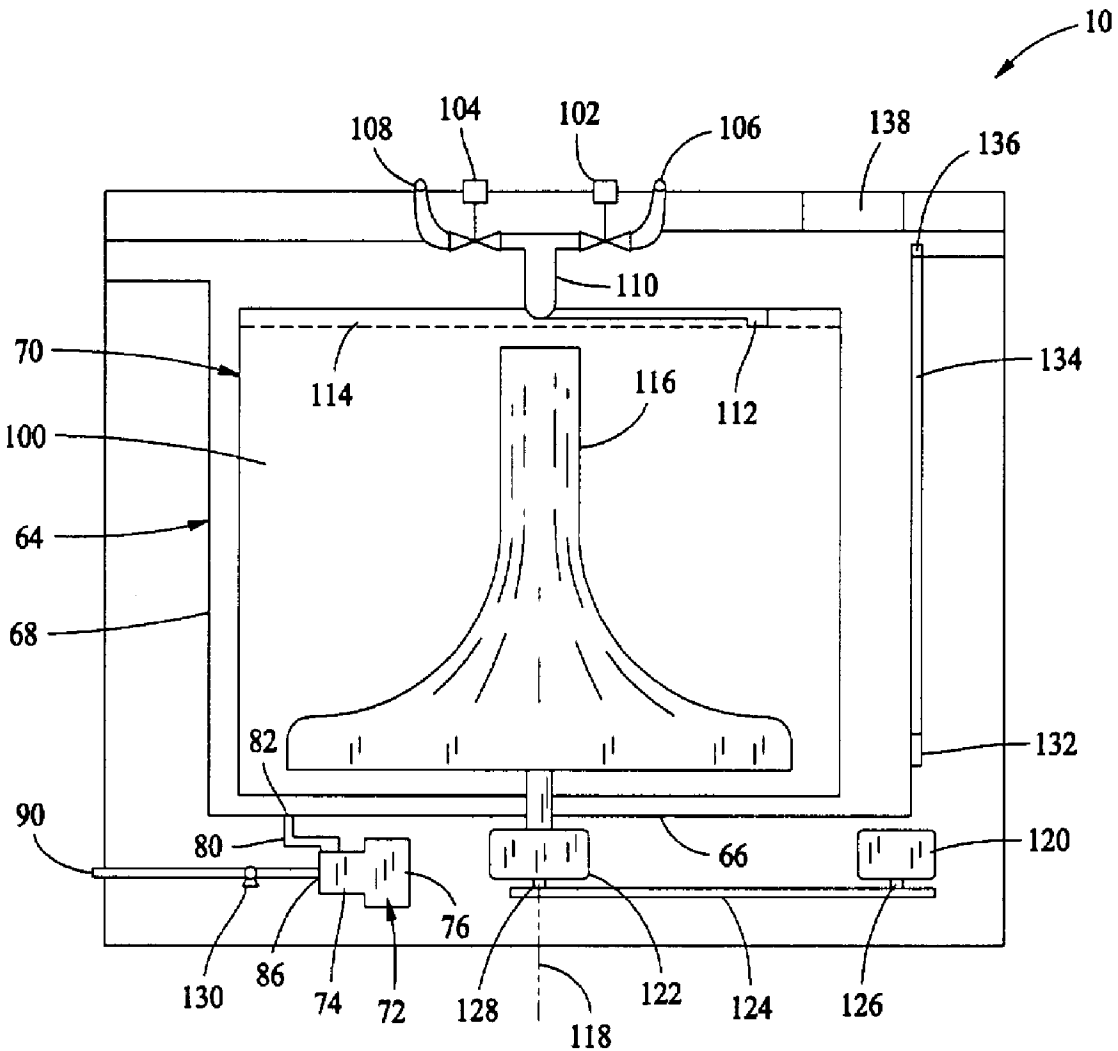
FIG. 2 is front elevational schematic view of the washing machine shown in FIG. 1.

FIG. 2 is a front elevational schematic view of washing machine 50 including wash basket 70 movably disposed and rotatably mounted in wash tub 64 in a spaced apart relationship from tub side wall 64 and tub bottom 66. Basket 70 includes a plurality of perforations therein to facilitate fluid communication between an interior of basket 70 and wash tub 64.

A hot liquid valve 102 and a cold liquid valve 104 deliver fluid, such as water, to basket 70 and wash tub 64 through a respective hot liquid hose 106 and a cold liquid hose 108. Liquid valves 102, 104 and liquid hoses 106, 108 together form a liquid supply connection for washing machine 50 and, when connected to a building plumbing system (not shown), provide a fresh water supply for use in washing machine 50. Liquid valves 102, 104 and liquid hoses 106, 108 are connected to a basket inlet tube 110, and fluid is dispersed from inlet tube 110 through a known nozzle assembly 112 having a number of openings therein to direct washing liquid into basket 70 at a given trajectory and velocity. A known dispenser (not shown in FIG. 2), may also be provided to produce a wash solution by mixing fresh water with a known detergent or other composition for cleansing of articles in basket 70.

In an alternative embodiment, a known spray fill conduit 114 (shown in phantom in FIG. 2) may be employed in lieu of nozzle assembly 112. Along the length of the spray fill conduit 114 are a plurality of openings arranged in a predetermined pattern to direct incoming streams of water in a downward tangential manner towards articles in basket 70. The openings in spray fill conduit 114 are located a predetermined distance apart from one another to produce an overlapping coverage of liquid streams into basket 70. Articles in basket 70 may therefore be uniformly wetted even when basket 70 is maintained in a stationary position.

A known agitation element 116, such as a vane agitator, impeller, auger, or oscillatory basket mechanism, or some combination thereof is disposed in basket 70 to impart an oscillatory motion to articles and liquid in basket 70. In different embodiments, agitation element 116 may be a single action element (i.e., oscillatory only), double action (oscillatory movement at one end, single direction rotation at the other end) or triple action (oscillatory movement plus single direction rotation at one end, singe direction rotation at the other end). As illustrated in FIG. 2, agitation element 116 is oriented to rotate about a vertical axis 118.

Basket 70 and agitator 116 are driven by motor 120 through a transmission and clutch system 122. A transmission belt 124 is coupled to respective pulleys of a motor output shaft 126 and a transmission input shaft 128. Thus, as motor output shaft 126 is rotated, transmission input shaft 128 is also rotated. Clutch system 122 facilitates driving engagement of basket 70 and agitation element 116 for rotatable movement within wash tub 64, and clutch system 122 facilitates relative rotation of basket 70 and agitation element 116 for selected portions of wash cycles. Motor 120, transmission and clutch system 122 and belt 124 collectively are referred herein as a machine drive system.

Washing machine 50 also includes a brake assembly (not shown) selectively applied or released for respectively maintaining basket 70 in a stationary position within tub 64 or for allowing basket 70 to spin within tub 64. Pump assembly 72 is selectively activated, in the example embodiment, to remove liquid from basket 70 and tub 64 through drain outlet 90 and a drain valve 130 during appropriate points in washing cycles as machine 50 is used. In an exemplary embodiment, machine 50 also includes a reservoir 132, a tube 134 and a pressure sensor 136. As fluid levels rise in wash tub 64, air is trapped in reservoir 132 creating a pressure in tube 134 that pressure sensor 136 monitors. Liquid levels, and more specifically, changes in liquid levels in wash tub 64 may therefore be sensed, for example, to indicate laundry loads and to facilitate associated control decisions. In further and alternative embodiments, load size and cycle effectiveness may be determined or evaluated using other known indicia, such as motor spin, torque, load weight, motor current, and voltage or current phase shifts.

Operation of machine 50 is controlled by a controller 138 which is operatively coupled to the user interface input located on washing machine backsplash 56 (shown in FIG. 1) for user manipulation to select washing machine cycles and features. In response to user manipulation of the user interface input, controller 138 operates the various components of machine 50 to execute selected machine cycles and features.

In an illustrative embodiment, clothes are loaded into basket 70, and washing operation is initiated through operator manipulation of control input selectors 60 (shown in FIG. 1). Tub 64 is filled with water and mixed with detergent to form a wash fluid, and basket 70 is agitated with agitation element 116 for cleansing of clothes in basket 70. That is, agitation element is moved back and forth in an oscillatory back and forth motion. In the illustrated embodiment, agitation element 116 is rotated clockwise a specified amount about the vertical axis of the machine, and then rotated counterclockwise by a specified amount. The clockwise/counterclockwise reciprocating motion is sometimes referred to as a stroke, and the agitation phase of the wash cycle constitutes a number of strokes in sequence. Acceleration and deceleration of agitation element 116 during the strokes imparts mechanical energy to articles in basket 70 for cleansing action. The strokes may be obtained in different embodiments with a reversing motor, a reversible clutch, or other known reciprocating mechanism.

After the agitation phase of the wash cycle is completed, tub 64 is drained with pump assembly 72. Clothes are then rinsed and portions of the cycle repeated, including the agitation phase, depending on the particulars of the wash cycle selected by a user.

Figure 3:
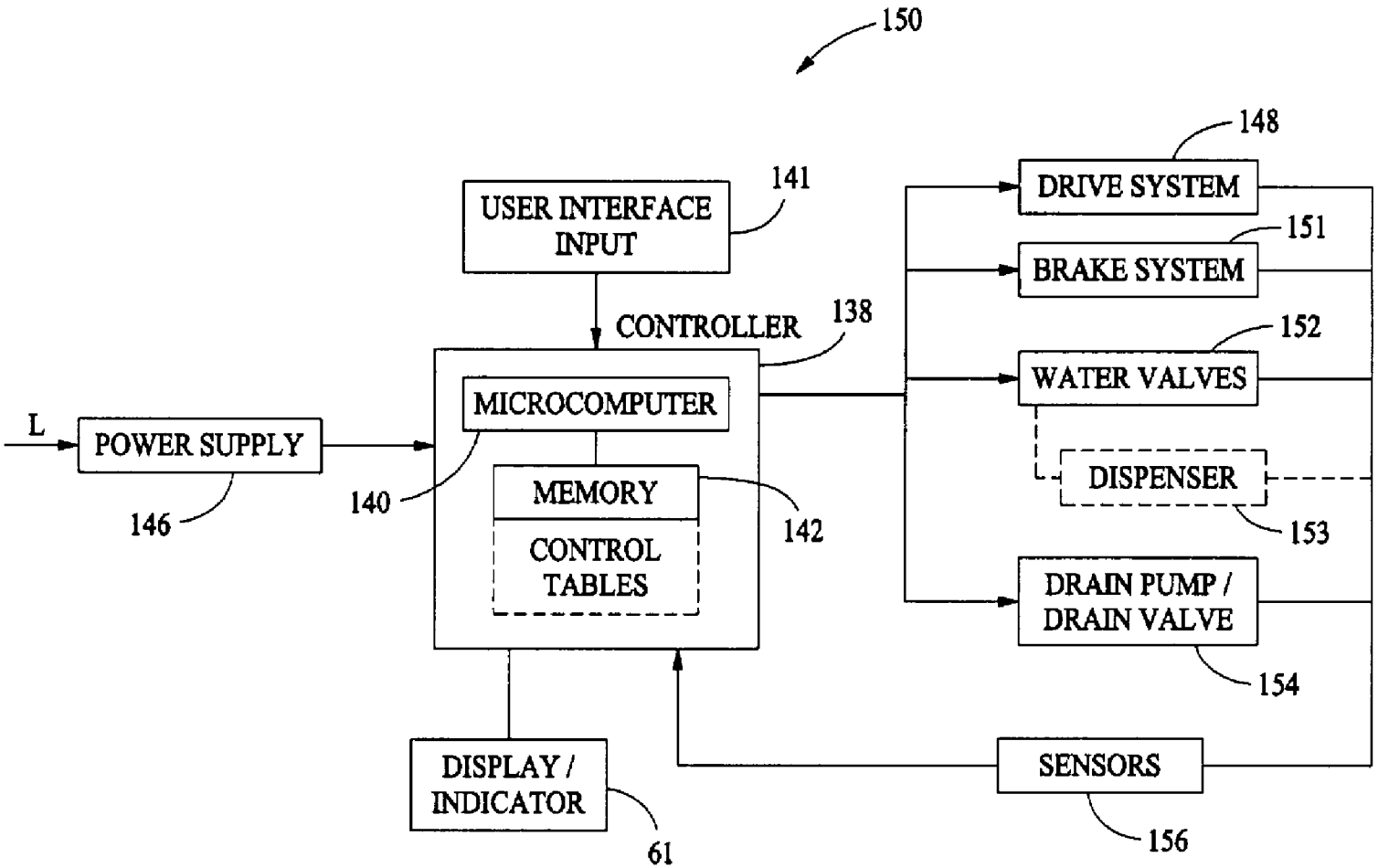
FIG. 3 is a schematic block diagram of a control system for the washing machine shown in FIGS. 1 and 2.

FIG. 3 is a schematic block diagram of an exemplary washing machine control system 150 for use with washing machine 50 (shown in FIGS. 1 and 2). Control system 150 includes controller 138 which may, for example, be a microcomputer 140 coupled to a user interface input 141. An operator may enter instructions or select desired washing machine cycles and features via user interface input 141, such as through input selectors 60 (shown in FIG. 1) and a display or indicator 61 coupled to microcomputer 140 displays appropriate messages and/or indicators, such as a timer, and other known items of interest to washing machine users. A memory 142 is also coupled to microcomputer 140 and stores instructions, calibration constants, and other information as required to satisfactorily complete a selected wash cycle. Memory 142 may, for example, be a random access memory (RAM). In alternative embodiments, other forms of memory could be used in conjunction with RAM memory, including but not limited to flash memory (FLASH), programmable read only memory (PROM), and electronically erasable programmable read only memory (EEPROM).

Power to control system 150 is supplied to controller 138 by a power supply 146 configured to be coupled to a power line L. Analog to digital and digital to analog converters (not shown) are coupled to controller 138 to implement controller inputs and executable instructions to generate controller output to washing machine components such as those described above in relation to FIGS. 1 and 2. More specifically, controller 138 is operatively coupled to machine drive system 148 (e.g., motor 120, clutch system 122, and agitation element 116 shown in FIG. 2), a brake assembly 151 associated with basket 70 (shown in FIG. 2), machine water valves 152 (e.g., valves 102, 104 shown in FIG. 2) and machine drain system 154 (e.g., drain pump assembly 72 and/or drain valve 130 shown in FIG. 2) according to known methods. In a further embodiment, water valves 152 are in flow communication with a dispenser 153 (shown in phantom in FIG. 3) so that water may be mixed with detergent or other composition of benefit to washing of garments in wash basket 70.

In response to manipulation of user interface input 141 controller 138 monitors various operational factors of washing machine 50 with one or more sensors or transducers 156, and controller 138 executes operator selected functions and features according to known methods. Of course, controller 138 may be used to control washing machine system elements and to execute functions beyond those specifically described herein. Controller 138 operates the various components of washing machine 50 in a designated wash cycle familiar to those in the art of washing machines.

To facilitate reducing the energy consumption of the washing machine, it is possible to utilize at least some cold water for a hot wash operation. That is, by adding cold water for a hot wash operation, the water level required for the hot wash can be achieved and less hot water is used.

Rather than adding an additional cold water valve having a different flow rate compared to the cold water valve use for cold water fills, and/or using a single timed scheme for adding cold water for a hot wash, and in one embodiment, a pulse control is used to pulse the cold water valve on during the hot wash fill.

Figure 4:
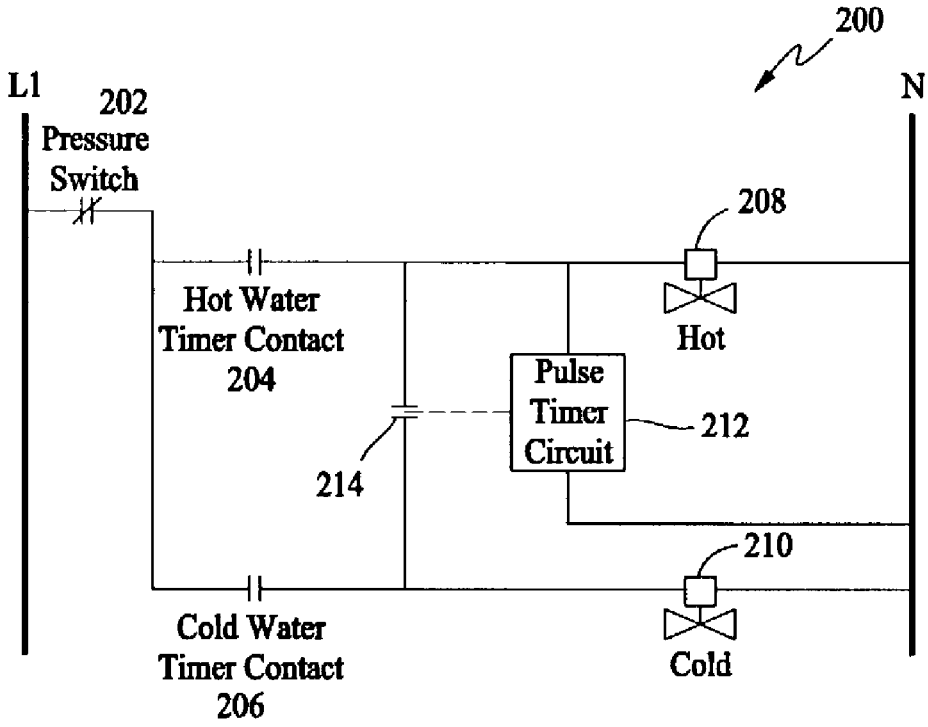
FIG. 4 is a schematic diagram of a pulsed cold temperature control.

FIG. 4 is a schematic diagram of a pulsed cold temperature control 200. Control 200 includes a pressure switch 202 coupled to a hot water timer contact 204 and a cold water timer contact 206. Hot water timer contact 204 is coupled to a hot water valve solenoid 208 and cold water timer contact 206 is coupled to a cold water valve solenoid 210. A pulse timer circuit 212 is coupled to a switch 214, which is used to pulse cold water valve solenoid 210 during hot water fill operations.

Generally, by cycling the cold water valve with a pre-set duty cycle (e.g., fixed or variable duty cycle), the fill level and fill time effects are minimized. If the fill time is longer, due to low water flow rates, the cold water valve cycles more times. If the fill time is shorter due to high fill rates, or a small fill level, the cold water valve will cycles less times. To limit valve wear, the frequency of the cycling should be as slow as possible, while allowing for the correct temperature control of the smallest load with the highest fill rate.

Set forth below are descriptions of various embodiments for a control to pulse the cold water valve on during a hot fill operation. Of course, many alternatives to the specific embodiments described below are possible. Specifically, a non-temperature compensated control, a temperature compensated control, and a microprocessor based control are described below.

Non-Temperature Compensated Control

Figure 5:
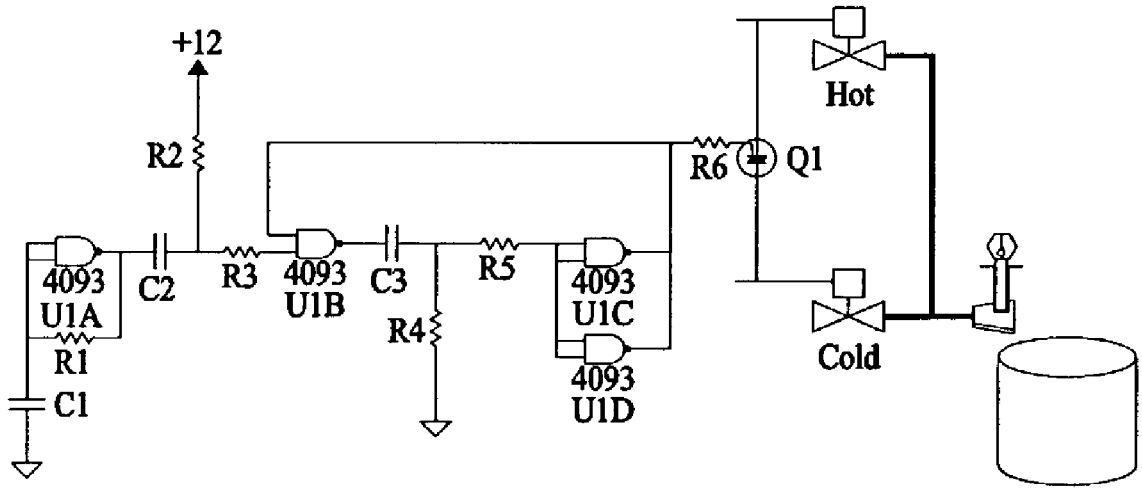
FIG. 5 is a schematic diagram of a non-temperature compensated pulse circuit.

FIG. 5 is a schematic diagram of a non-temperature compensated pulse circuit (i.e., the cold water valve is pulsed on, or energized, in accordance with a fixed duty cycle). Logic gate U1A, resistor R1 and capacitor C1 form a free running multivibrator generating a square wave output due to logic gate U1 being a Schmitt trigger NAND gate. Capacitor C2, resistor R2, and resistor R3 form an integrator. The negative edge of the square wave from logic gate U1A is passed by capacitor C2, through current limiting resistor R3 to logic gate U1B. Logic gates U1B, U1C, U1D, capacitor C3, and resistors R4 and R5 form a one-shot circuit. The negative pulse through resistor R3 causes a positive pulse, which is passed by capacitor C3 and resistor R5 to logic gates U1C and U1D. Logic gates U1C and U1D generate a negative pulse which is fed back to logic gate U1B thereby latching the circuit. This signal also turns on triac Q1. The positive voltage on capacitor C3 bleeds off through resistor R4, thereby charging C3. When a low level is reached, the output of logic gates U1C and U1D becomes positive, turning off triac Q1 and resetting the one-shot. The period is therefore determined by the clock speed of U1A clock, and the ON time is determined by the one-shot timing.

Temperature Compensated Control

Figure 6:
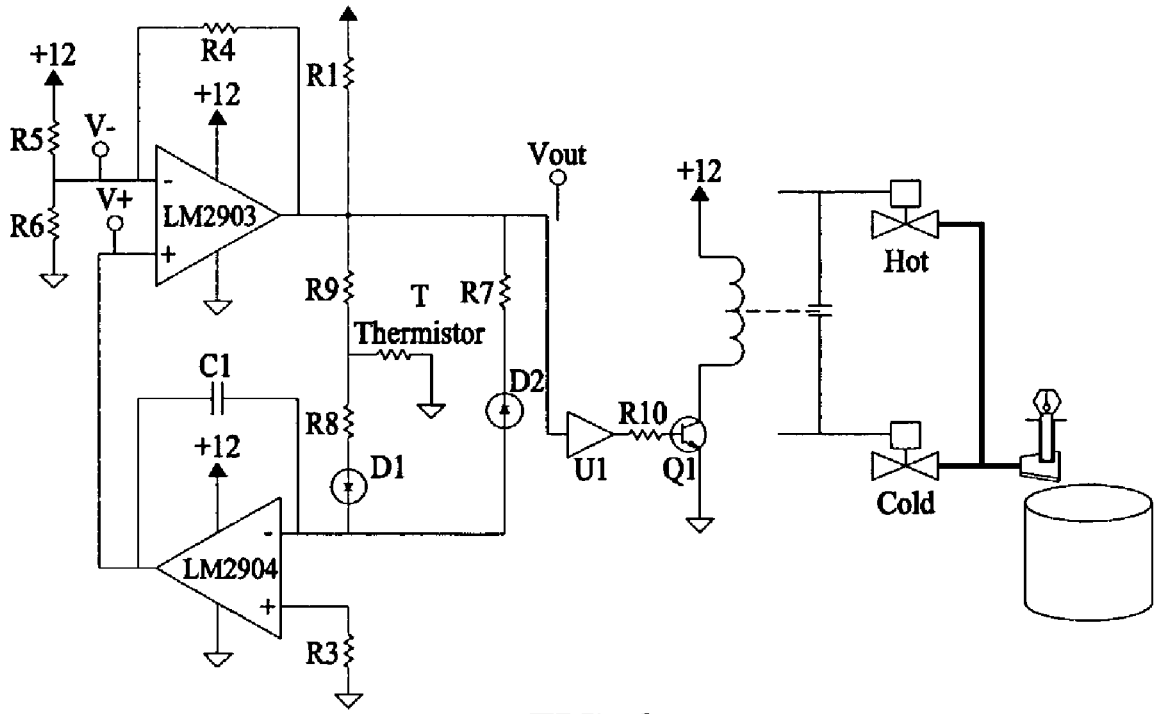
FIG. 6 is a schematic diagram of a temperature compensated pulse circuit.

FIG. 6 is a schematic diagram of a temperature compensated pulse circuit (i.e., the cold water valve is pulsed on, or energized, in accordance with a duty cycle that varies with water temperature). The circuit illustrated in FIG. 6 has three major portions, namely, a voltage set point portion, an integrator portion, and a drive circuit portion. The voltage set point control portion of the circuit includes resistors R5, R6, comparator LM2903 and resistor R1. Resistors R5 and R6 set the center or the set point voltage, and resistors R4 and R1 set the hystersis of the set points.

The integrator includes resistors R1, R8, R7, R9, thermistor T, and diodes D1 and D2. Thermistor T and diodes D1 and D2 allow for independent setting of the rising and falling slope of the integrator. Capacitor C1, resistors R1, R8, and R9, and the thermistor set the falling slope. Capacitor C1 and resistor R7 set the rising slope.

The drive circuit includes amplifier U1 and transistor Q1. Amplifier U1 isolates the output control signal from transistor Q1. Transistor Q1 sinks current through the relay coil. When transistor Q1 is on, the relay contact is closed, and the cold water valve is open.

With regard to the operation of the circuit shown in FIG. 6, and when the cold water valve is open, given that voltage V+ is greater than voltage V−, then voltage Vout is +12 V and transistor Q1 is on. Voltage V+ will be decreasing. The rate of change for voltage V+ is a function of the thermistor resistance. Since thermistor T has a negative temperature coefficient, as the temperature of the water decreases the resistance of thermistor T increases. This resistance change by the thermistor causes the voltage drop across thermistor T to increase, causing the slope of the integrator to increase. An increase in the slope of the integrator will cause the voltage V+ to decrease faster, causing the water valve to close earlier.

With the cold water valve closed, given that voltage V+ is less than voltage V−, then voltage Vout will be 0 V and transistor Q1 is off. Voltage V+ will be increasing. The rate of change for voltage V+ is a function of resistor R7 and capacitor C1. The valve will remain closed until voltage V+ is greater than voltage V− then voltage Vout will go high and transistor Q1 will turn on, opening the cold water valve.

Processor Based Control

Figure 7:
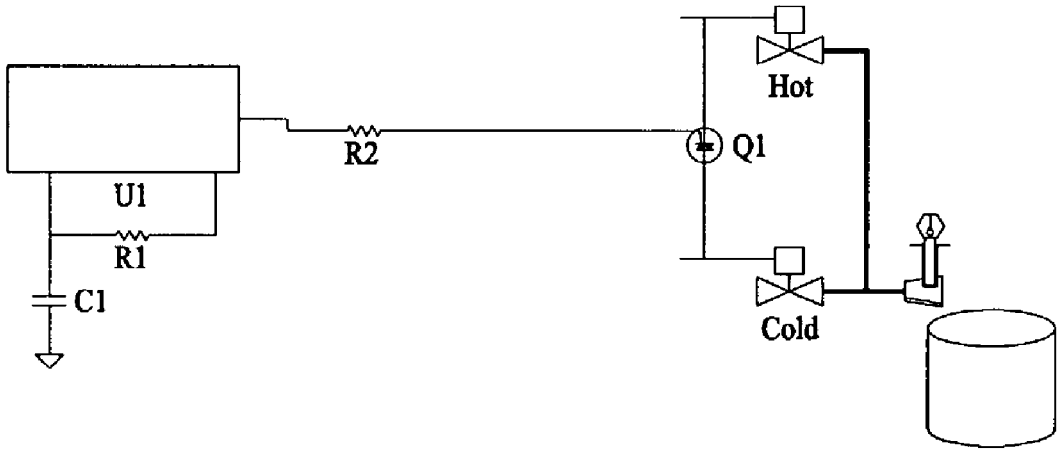
FIG. 7 is a block diagram of a processor based control circuit.

FIG. 7 is a block diagram of a processor based control circuit. Processor U1 is coupled to a biasing resistor R1 and capacitor C1, which set the clock rate of the processor. A control line from processor U1 is coupled to triac Q1 via resistor R2, and thereby controls the state of triac Q1. Triac Q1 is connected between the hot and cold valves.

Figure 8:
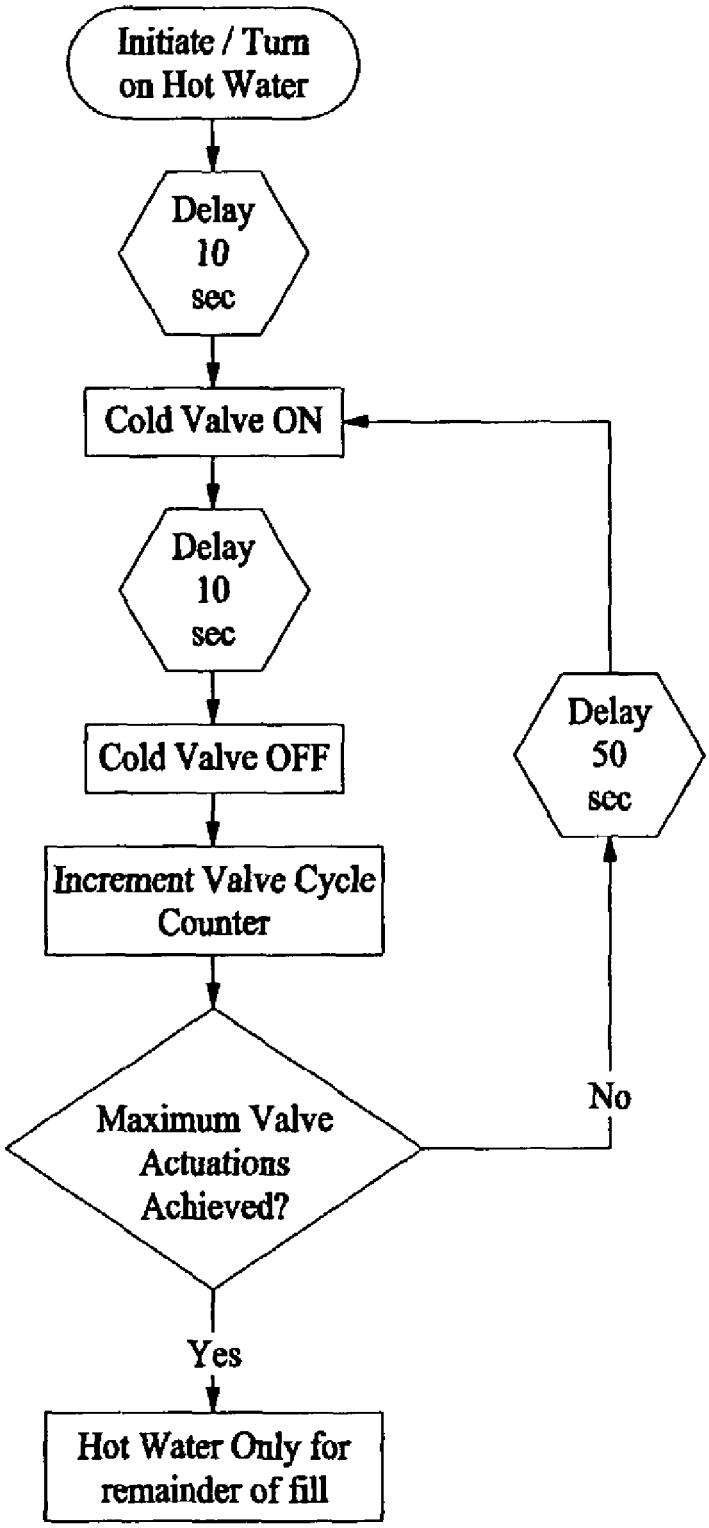
FIG. 8 is a flow diagram illustrating process steps for controlling valve operation during a hot wash fill.

FIG. 8 is a flow diagram illustrating process steps executed by processor U1 (FIG. 7) for controlling valve operation during a hot wash fill. Generally, a pulsed timing algorithm works such that the cold water valve is controlled by a specific duty cycle which turns the valve on and off at specific intervals (for example, the valve is on for ten seconds of every sixty seconds of fill time). The hot water valve remains on during the course of the entire fill. The number of valve actuations is limited to a total of ten per fill for noise and valve life considerations. The pulsed timing algorithm can end in one of two ways. In one case, the pressure switch indicates the tub is full and the water valves are turned off. In the other case, the maximum number of valve actuations has been reached and only hot water continues to fill the tub.

Referring specifically to FIG. 8, for a hot fill operation, processor U1 causes the hot water valve to open. After a delay of a predetermined period of time (e.g., 10 seconds), processor U1 causes the cold water valve to open (e.g., energize the solenoid that opens the valve). After another delay of a predetermined period of time (e.g., 10 seconds), processor U1 causes the cold water valve to close. A counter is then incremented, and then the value of the counter is compared to a predetermined maximum number of valve actuations. If the counter value is less than the maximum number of valve actuations, then processor U1 delays for a predetermined time period (e.g., 50 seconds) before again turning the cold valve on. Once the counter value is equal to the maximum number of valve actuations, then for the remainder of the fill, only hot water is used (i.e., processor U1 keeps the hot water valve open and does not pulse on the cold water valve).

Rather than energizing the cold water valve with the fixed duty cycle as described above, processor U1 can be programmed to vary the pulsing of the cold water valve (i.e., varying the duty cycle). For example, a temperature sensor (e.g., thermistor) can be coupled to the microprocessor and positioned so that the resistance of the sensor is representative of the water temperature in the washing machine. The microprocessor can be programmed to vary the duty cycle of the cold water valve during a hot fill operation based on a sensor signal. For example, if the water temperature is colder, the cold water valve could be on for a shorter period of time whereas if the water temperature is hotter, the cold water valve could be on for a longer period of time. Of course, other variations are possible.

The above described control facilitates reducing hot water usage in a washing machine, which in turn facilitates reducing energy consumption by the machine during wash operations. Specifically, by avoiding the use of only hot water during a hot wash fill, energy consumption of the washing machine can be reduced.

Further, and rather than adding a cold water valve for use during a hot fill operation, such control uses the cold water valve normally used for cold fill operations. Therefore, the cost and complexity of adding another valve to the valve system is avoided. Further, the cost and complexity of adding a temperature sensing device also is avoided. In addition, by cycling the cold water valve as described above, the fill level and fill time effects can be minimized.

While the invention has been described in terms of various specific embodiments, those skilled in the art will recognize that the invention can be practiced with modification within the spirit and scope of the claims.

The invention claimed is:

1. A washing machine comprising:

a cabinet;

a tub and a basket mounted within said cabinet;

an agitation element mounted within said basket;

a cold water valve for controlling a flow of cold water to said tub, wherein said cold water valve is configured to be periodically pulsed between an open position and a closed position based on a speed of a clock;

a hot water valve for controlling a flow of hot water to said tub; and a control coupled to said cold water valve to pulse said cold water valve between the open position and the closed position during a hot fill operation, wherein said hot water valve is configured to remain open during the pulsing of said cold water valve, and said control is configured to control said cold water valve such that said cold water valve operates independent of a temperature of water delivered to said washing machine, such that a mixture of hot water and cold water is channeled to said tub when the cold water valve is in the open position and only hot water is channeled to said tub when the cold water valve is in the closed position during the hot fill operation, said control comprising a microprocessor coupled to a memory storing executable instructions that, when executed by the microprocessor, directs the control to:

open said cold water valve to the open position for a first time interval;

close said cold water valve to the closed position after the first time interval has elapsed and increment a counter;

compare a value of said counter to a maximum number of valve actuations;

if the value is less than the maximum number of valve actuations, delay for a second time interval and open said cold water valve to the open position for the first time interval; and if the value is equal to the maximum number of valve actuations, complete the hot fill operation using only hot water.

2. A washing machine in accordance with claim 1 wherein said control energizes said cold water valve in accordance with one of a fixed duty cycle and a variable duty cycle.

3. A washing machine comprising:

a cabinet;

a tub and a basket mounted within said cabinet;

an agitation element mounted within said basket;

a cold water valve for controlling a flow of cold water to said tub, wherein said cold water valve is configured to be periodically pulsed between an open position and a closed position based on a speed of a clock;

a hot water valve for controlling a flow of hot water to said tub; and a control coupled to said cold water valve to pulse said cold water valve between the open position and the closed position during a hot fill operation, wherein said hot water valve is configured to remain open during the pulsing of said cold water valve, and said control is configured to control said cold water valve such that said cold water valve operates independent of a temperature of water delivered to said washing machine, such that a mixture of hot water and cold water is channeled to said tub when the cold water valve is in the open position and only hot water is channeled to said tub when the cold water valve is in the closed position during the hot fill operation, said control comprising a microprocessor coupled to a memory storing executable instructions that, when executed by the microprocessor, directs the control to:

open said cold water valve to the open position for a first time interval;

close said cold water valve to the closed position after the first time interval has elapsed and increment a counter;

compare a value of said counter to a maximum number of valve actuations;

if the value is less than the maximum number of valve actuations, delay for a second time interval and open said cold water valve to the open position for the first time interval; and if the value is equal to the maximum number of valve actuations, complete the hot fill operation using only hot water.

4. A washing machine in accordance with claim 3 wherein said control energizes said cold water valve in accordance with one of a fixed duty cycle and a variable duty cycle.

* * * * *